US007298349B2

(12) United States Patent
Tachibana et al.

(10) Patent No.: US 7,298,349 B2
(45) Date of Patent: Nov. 20, 2007

(54) DRIVE METHOD FOR PLASMA DISPLAY PANEL

(75) Inventors: Hiroyuki Tachibana, Osaka (JP); Toshikazu Wakabayashi, Osaka (JP); Shigeo Kigo, Osaka (JP); Nobuaki Nagao, Osaka (JP); Kenji Ogawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 94 days.

(21) Appl. No.: 10/515,503

(22) PCT Filed: Mar. 23, 2004

(86) PCT No.: PCT/JP2004/003946

§ 371 (c)(1),
(2), (4) Date: Nov. 24, 2004

(87) PCT Pub. No.: WO2004/086340

PCT Pub. Date: Oct. 7, 2004

(65) Prior Publication Data

US 2005/0200570 A1 Sep. 15, 2005

(30) Foreign Application Priority Data

Mar. 24, 2003 (JP) ..... 2003-080302

(51) Int. Cl.
*G09G 3/28* (2006.01)

(52) U.S. Cl. ..... 345/60; 345/67; 315/169.4

(58) Field of Classification Search ..... 345/37–42, 345/60–69; 315/169.1–169.4
See application file for complete search history.

(56) References Cited

U.S. PATENT DOCUMENTS

| | | | | |
|---|---|---|---|---|
| 6,496,167 | B2 * | 12/2002 | Makino | 345/60 |
| 6,833,824 | B2 * | 12/2004 | Ide et al. | 345/66 |
| 2001/0026254 | A1 * | 10/2001 | Ide et al. | 345/60 |
| 2004/0056606 | A1 * | 3/2004 | Ide et al. | 315/169.3 |
| 2004/0239593 | A1 * | 12/2004 | Yamada | 345/63 |

FOREIGN PATENT DOCUMENTS

| | | |
|---|---|---|
| JP | 8-96714 | 4/1996 |
| JP | 8-221036 | 8/1996 |
| JP | 9-245627 | 9/1997 |
| JP | 10-288973 | 10/1998 |
| JP | 2001-185034 | 7/2001 |
| JP | 2002-351397 | 12/2002 |

* cited by examiner

*Primary Examiner*—Vijay Shankar
(74) *Attorney, Agent, or Firm*—Wenderoth, Lind & Ponack, L.L.P.

(57) ABSTRACT

A method of driving a plasma display panel including a plurality of priming electrodes. The pulse width of scan pulses applied to some of a plurality of scan electrodes in which writing is performed and priming discharge is caused with the scanning of the scan electrodes is larger than the pulse width of scan pulses applied to the other scan electrodes in which writing is performed but no priming discharge is caused with the scanning of the scan electrodes.

5 Claims, 4 Drawing Sheets

DRIVE METHOD FOR PLASMA DISPLAY PANEL

TECHNICAL FIELD

The present invention relates to a method of driving a plasma display panel.

BACKGROUND ART

A plasma display panel (hereinafter abbreviated as a PDP or a panel) is a display device having excellent visibility and featuring a large screen, thinness and light weight. The systems of discharging a PDP include an alternating-current (AC) type and direct-current (DC) type. The electrode structures thereof include a three-electrode surface-discharge type and an opposite-discharge type. However, the current mainstream is an AC type three-electrode PDP, which is an AC surface-discharge type, because this type of PDP is suitable for higher definition and easy to manufacture.

Generally, an AC type three-electrode PDP has a large number of discharge cells formed between a front panel and rear panel faced with each other. In the front panel, a plurality of display electrodes, each made of a pair of scan electrode and sustain electrode, are formed on a front glass substrate in parallel with each other. A dielectric layer and a protective layer are formed to cover these display electrodes. In the rear panel, a plurality of parallel data electrodes is formed on a rear glass substrate. A dielectric layer is formed on the data electrodes to cover them. Further, a plurality of barrier ribs is formed on the dielectric layer in parallel with the data electrodes. Phosphor layers are formed on the surface of the dielectric layer and the side faces of the barrier ribs. Then, the front panel and the rear panel are faced with each other and sealed together so that the display electrodes and data electrodes intersect with each other. A discharge gas is filled into an inside discharge space formed therebetween. In a panel structured as above, ultraviolet light is generated by gas discharge in each discharge cell. This ultraviolet light excites respective phosphors to emit R, G, or B color, for color display.

A general method of driving a panel is a so-called sub-field method: one field period is divided into a plurality of sub-fields and combination of light-emitting sub-fields provides gradation images for display. Now, each of the sub-fields has an initializing period, writing period, and sustaining period.

In the initializing period, all the discharge cells perform initializing discharge operation at a time to erase the history of wall electric charge previously formed in respective discharge cells and form wall electric charge necessary for the subsequent writing operation. Additionally, this initializing discharge operation serves to generate priming (priming for discharge=excited particles) for causing stable writing discharge.

In the writing period, scan pulses are sequentially applied to scan electrodes, and write pulses corresponding to the signals of an image to be displayed are applied to data electrodes. Thus, selective writing discharge is caused between scan electrodes and corresponding data electrodes for selective formation of wall electric charge.

In the subsequent sustaining period, a predetermined number of sustain pulses are applied between scan electrodes and corresponding sustain electrodes. Then, the discharge cells in which wall electric charge are formed by the writing discharge are selectively discharged and light is emitted from the discharge cells.

In this manner, to properly display an image, selective writing discharge must securely be performed in the writing period. However, there are many factors in increasing discharge delay in the writing discharge: restraints of the circuitry inhibit the use of high voltage for write pulses; and phosphor layers formed on the data electrodes make discharge difficult. For these reasons, priming for generating stable writing discharge is extremely important.

However, the priming caused by discharge rapidly decreases as time elapses. This causes the following problems in the method of driving a panel described above. In writing discharge occurring a long time after the initializing discharge, priming generated in the initializing discharge is insufficient. This insufficient priming causes a large discharge delay and unstable wiring operation, thus degrading the image display quality. Additionally, when a long wiring period is set for stable wiring operation, the time taken for the writing period is too long.

Proposed to address these problems are a panel and method of driving the panel in which auxiliary discharge electrodes are provided and discharge delay is minimized using priming caused by auxiliary discharge (see Japanese Patent Unexamined Publication No. 2002-297091, for example).

However, such panels have the following problems. Because the discharge delay of the auxiliary discharge itself is large, the discharge delay of the writing discharge cannot sufficiently be shortened. Additionally, because the operating margin of the auxiliary discharge is small, incorrect discharge may be induced in some panels.

Further, when the number of scan electrodes is increased for higher definition without shortening the discharge delay in the writing discharge sufficiently, the time taken for the writing period is too long and the time taken for the sustaining period is insufficient. As a result, luminance decreases. Additionally, increasing the partial pressure of xenon to increase the luminance and efficiency further increases the discharge delay and makes the writing operation unstable.

The present invention addresses these problems and aims to provide a method of driving a plasma display panel capable of performing stable and high-speed writing operation.

DISCLOSURE OF THE INVENTION

To address these problems, in the method of driving a plasma display panel of the present invention, the pulse width of scan pulses applied to scan electrodes in which writing operation is performed but no priming discharge is caused with the scanning of the scan electrodes is shorter than the pulse width of scan pulses applied to other scan electrodes in which writing operation is performed and priming discharge is caused with the scanning of the scan electrodes, in the writing period.

DETAILED DESCRIPTION OF PREFERRED EMBODIMENT

A method of driving a plasma display panel in accordance with an exemplary embodiment of the present invention is described hereinafter with reference to the accompanying drawings.

Exemplary Embodiment

Figure 1:
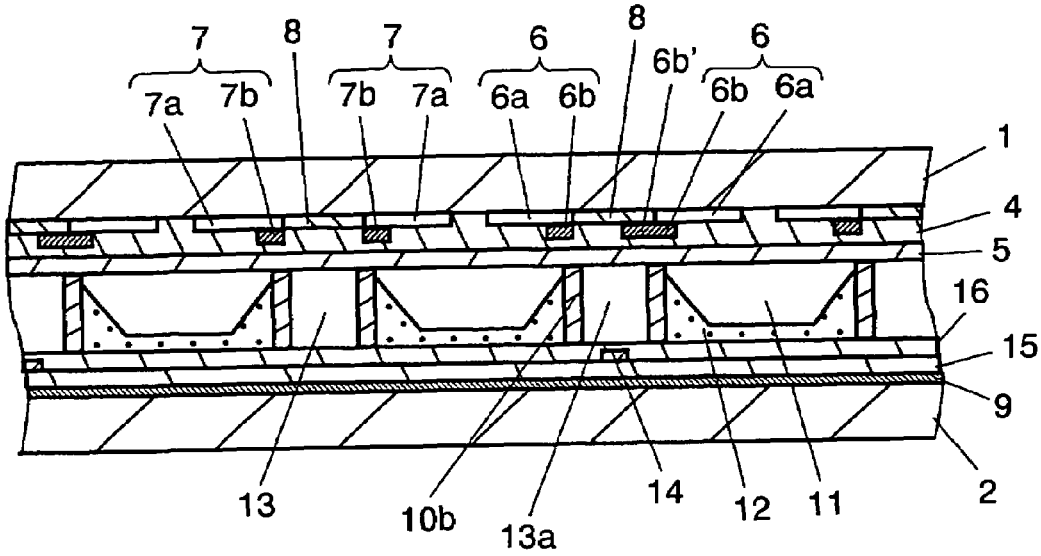
FIG. 1 is a sectional view showing an example of a panel used for an exemplary embodiment of the present invention.
Figure 2:
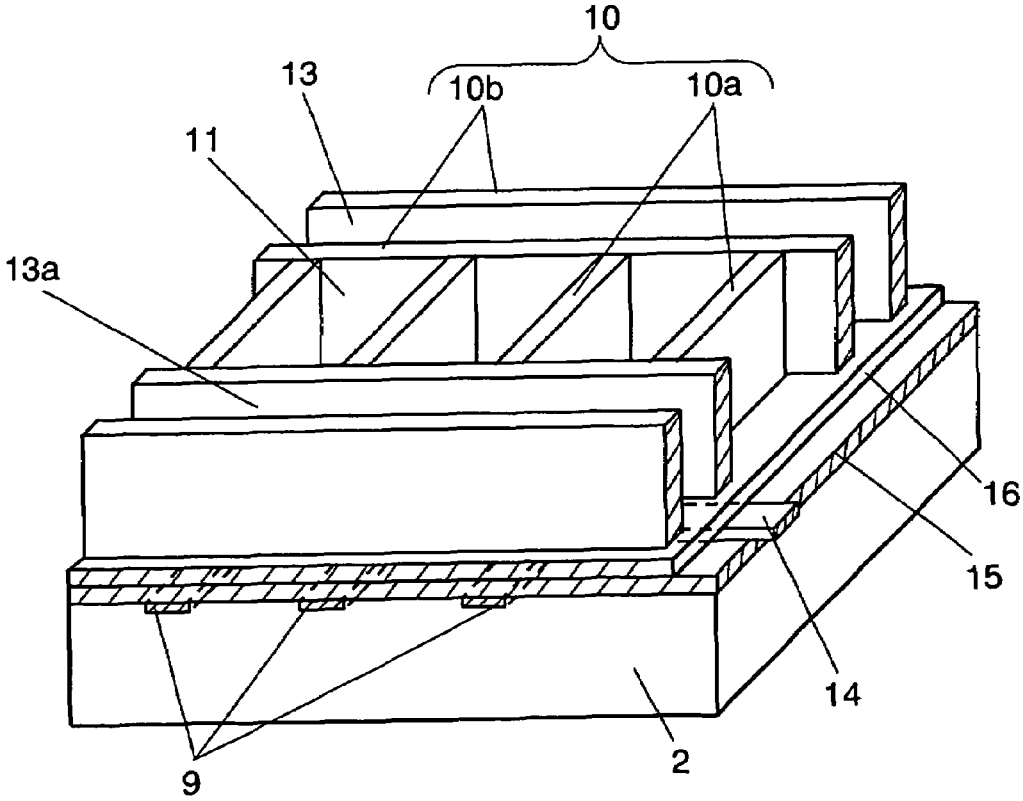
FIG. 2 is a schematic perspective view showing a structure of a rear substrate side of the panel.

FIG. 1 is a sectional view showing an example of a panel used for the exemplary embodiment of the present invention. FIG. 2 is a schematic perspective view showing the structure of the rear substrate side of the panel.

As shown in FIG. 1, front substrate 1 and rear substrate 2 both made of glass are faced with each other to sandwich a discharge space therebetween. In the discharge space, a mixed gas of neon and xenon for radiating ultraviolet light by discharge is filled.

On front substrate 1, a plurality of pairs of scan electrode 6 and sustain electrode 7 are formed in parallel with each other. Further, scan electrodes 6 and sustain electrodes 7 are alternately arranged in pairs like sustain electrode 7—scan electrode 6—scan electrode 6—sustain electrode 7—sustain electrode 7—scan electrode 6, etc. Scan electrode 6 and sustain electrode 7 are made of transparent electrodes 6*a* and 7*a*, and metal buses 6*b* and 7*b* formed on transparent electrodes 6*a* and 7*a*, respectively. Now, between one scan electrode 6 and the other scan electrode 6, and one sustain electrode 7 and the other scan electrode 7, light-absorbing layers 8, each made of a black material, are provided. Projection 6*b*' of metal bus 6*b* in one of adjacent scan electrodes 6 projects onto light-absorbing layer 8. Dielectric layer 4 and protective layer 5 are formed to cover these scan electrodes 6, sustain electrodes 7, and light-absorbing layers 8.

On rear substrate 2, a plurality of data electrodes 9 is formed in parallel with each other. Dielectric layer 15 is formed to cover these data electrodes 9. Further on the dielectric layer, barrier ribs 10 for partitioning the discharge space into discharge cells 11 are formed. As shown in FIG. 2, each barrier rib 10 is made of vertical walls 10*a* extending in parallel with data electrodes 9, and horizontal walls 10*b* for forming discharge cells 11 and forming clearance 13 between discharge cells 11. In clearance 13 faced with projection 6*b*' in scan electrode 6 among clearances 13, priming electrode 14 is formed in the direction orthogonal to data electrodes 9, to form priming cell 13*a*. In other words, priming electrodes 14 are not provided in all the clearances 13, and are formed in priming cells 13 in every other one of clearances 13. On the surface of dielectric layer 15 corresponding to discharge cells 11 and the side faces of barrier ribs 10, phosphor layers 12 are provided. However, no phosphor layer 12 is formed on the side of clearances 13.

When front substrate 1 is faced and sealed with rear substrate 2, each projection 6*b*' of metal bus 6*b* in scan electrode 6 formed on front substrate 1 that projects onto light-absorbing layer 8 is positioned in parallel with corresponding priming electrode 14 on rear substrate 2 and faced therewith in priming cell 13*a*. In other words, the panel shown in FIGS. 1 and 2 is structured to include priming cells 13*a*, each for performing priming discharge between projection 6*b*' formed on the side of front substrate 1 and priming electrode 14 formed on the side of rear substrate 2.

In FIGS. 1 and 2, dielectric layer 16 is further formed to cover priming electrodes 14.

Now, to facilitate causing priming discharge, phosphor layers 12 that hinder the discharge are not provided on priming cells 13*a*. Further, the interval between projection 6*b*' in scan electrode 6 and corresponding priming electrode 14 is shorter than the interval between data electrode 9 and corresponding scan electrode 6. Thus, the discharge-starting voltage of the priming discharge is lower than that of the writing discharge, and the priming discharge is more likely to occur.

Figure 3:
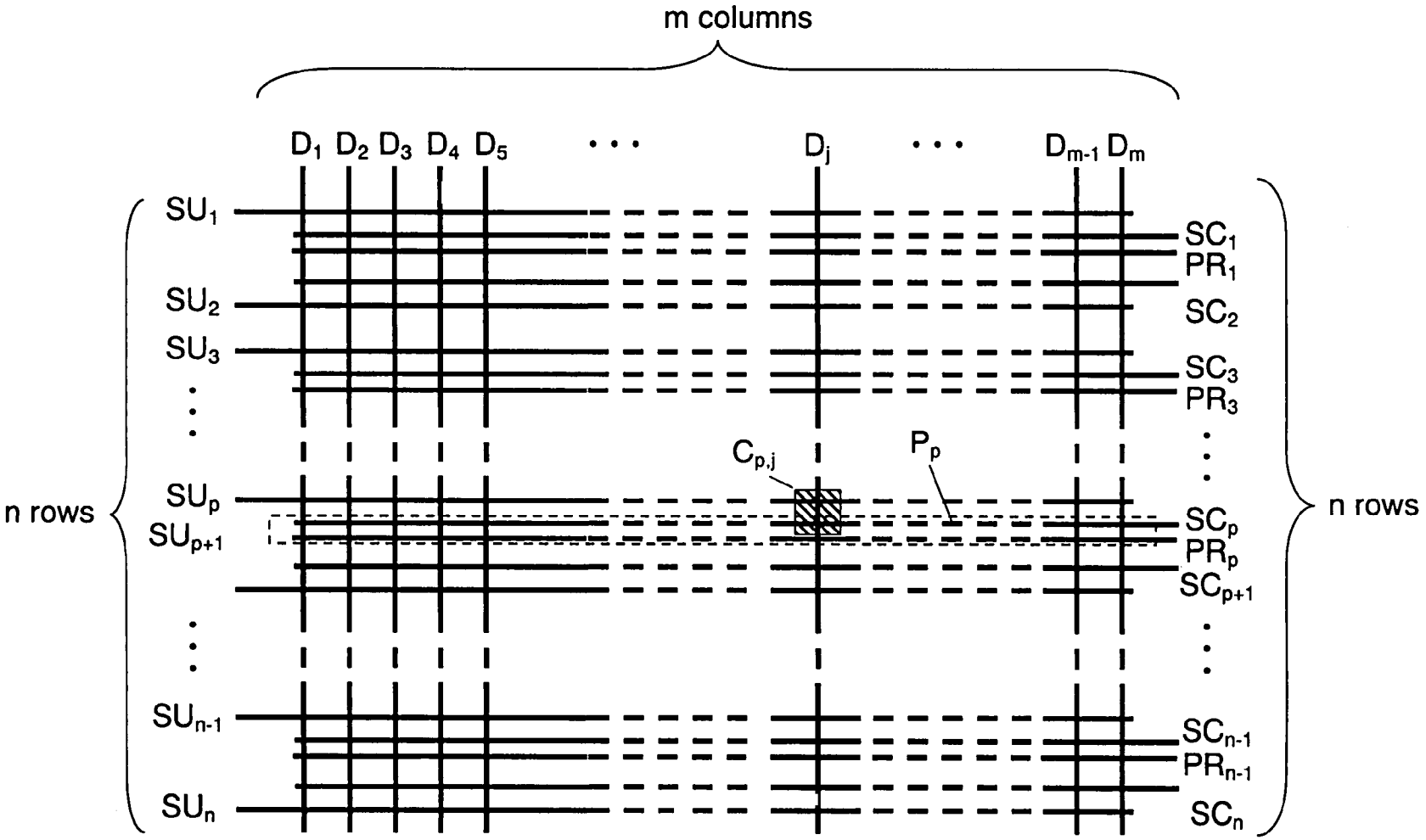
FIG. 3 is a diagram showing an arrangement of electrodes in the panel.

FIG. 3 is a diagram showing an arrangement of electrodes in the panel used for the exemplary embodiment of the present invention. M columns of data electrodes $D_1$ to $D_m$ (data electrodes 9 in FIG. 1) are arranged in the column direction. N rows of scan electrodes $SC_1$ to $SC_n$ (scan electrodes 6 in FIG. 1), and n rows of sustain electrodes $SU_1$ to $SU_n$ (sustain electrodes 7 in FIG. 1) are alternately arranged in pairs in the row direction like sustain electrode $SU_1$—scan electrode $SC_1$—scan electrode $SC_2$—sustain electrode $SU_2$, etc. In this embodiment, projections 6*b*' are provided only in odd-numbered scan electrodes $SU_1$, $SU_3$, etc. N/2 rows of priming electrodes $PR_1$, $PR_3$, etc. (priming electrode 14 in FIG. 1) are arranged to be faced with the corresponding projections of these scan electrodes $SU_1$, $SU_3$, etc.

Thus, m×n discharge cells $C_{ij}$ (discharge cells 11 in FIG. 1), each including a pair of scan electrode $SC_i$ and sustain electrode $SU_i$ (i=1 to n) and one data electrode $D_j$ (j=1 to m), are formed in the discharge space. N/2 rows of priming cells $P_p$ (priming cell 13*a* in FIG. 1), each including projection 6*b*' of scan electrode $SC_p$ (p=odd number) and priming electrode $PR_p$, are formed.

As described above, the panel used in the embodiment of the present invention, odd-numbered scan electrodes $SC_p$ are scan electrodes with projections 6*b*' in which writing operation is performed and priming discharge is caused during the scanning of the odd-numbered scan electrodes. On the other hand, even-numbered scan electrodes $SC_{p+1}$ are scan electrodes with no projections 6*b* in which writing operation is performed but no priming discharge is caused during the scanning of the even-numbered scan electrodes.

Next, a driving waveform for driving the panel and timing of the driving waveform are described.

Figure 4:
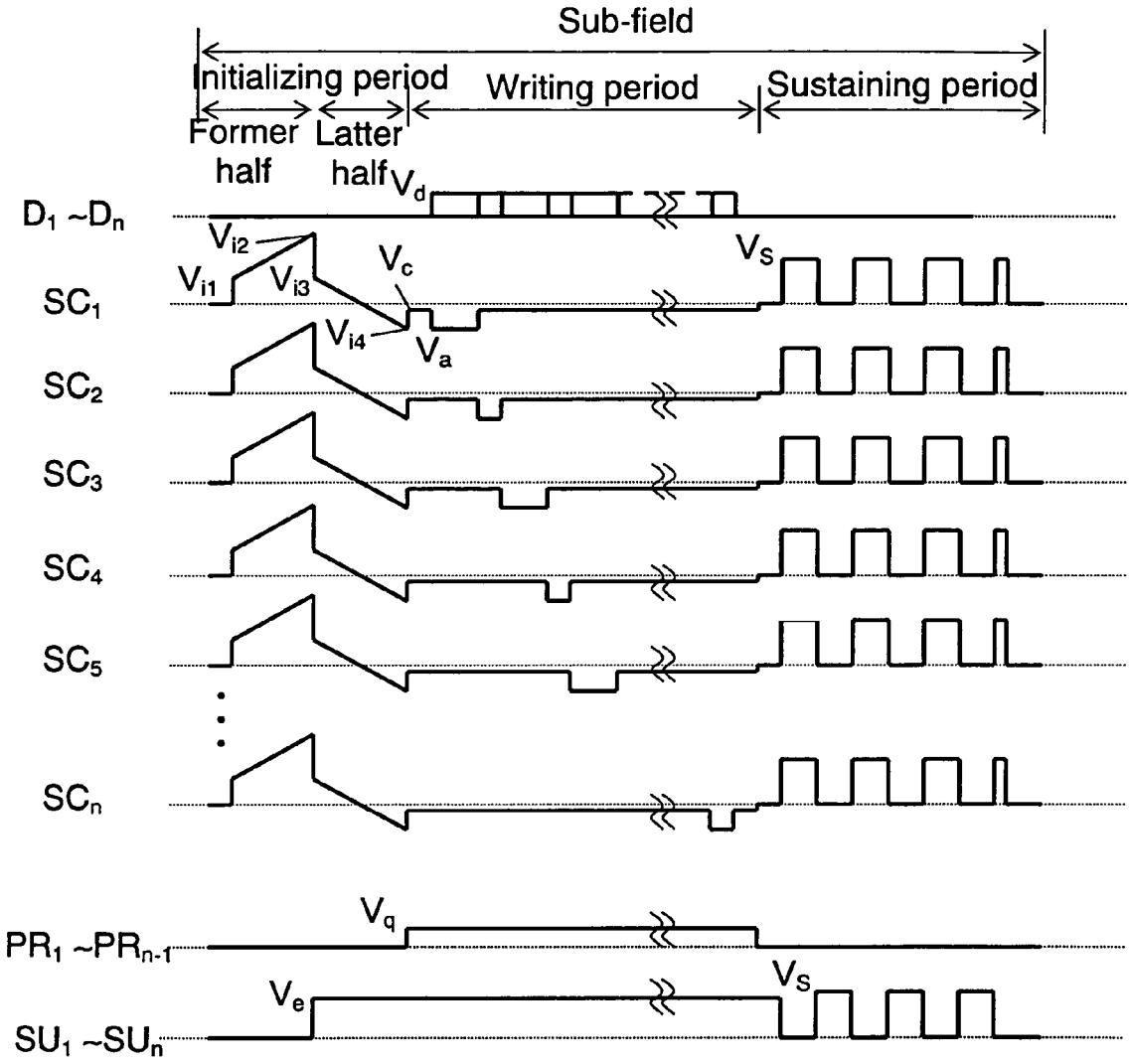
FIG. 4 is a diagram showing a driving waveform in a method of driving the panel.

FIG. 4 is a diagram showing a driving waveform in the method of driving the panel used for the exemplary embodiment of the present invention. In this embodiment, one field period is made of a plurality of sub-fields, each including an initializing period, writing period, and sustaining period. Because the same operation is performed in each sub-field, except for the number of sustain pulses in the sustaining period, operation in one sub-filed is described hereinafter.

In the former half of the initializing period, each of data electrodes $D_1$ to $D_m$, sustain electrode $SU_1$ to $SU_n$, and priming electrodes $PR_1$ to $PR_{n-1}$ is held at 0 (V). Applied to each of scan electrodes $SC_1$ to $SC_n$ is a ramp waveform voltage gradually increasing from a voltage of $V_{i1}$ not larger than discharge-starting voltage across the scan electrodes and sustain electrodes $SU_1$ to $SU_n$ to a voltage of $V_{i2}$ exceeding the discharge-starting voltage. While the ramp waveform voltage increases, first weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_{n-1}$. Thus, negative wall voltage accumulates on scan electrodes $SC_1$ to $SC_n$, and positive wall voltage accumulates on data electrodes $D_1$ to $D_m$, sustain electrodes $SU_1$ to $SU_n$, and priming electrodes $PR_1$ to $PR_{n-1}$. Now, the wall voltage on the electrodes is the voltage generated by the wall charge accumulating on the dielectric layers covering the electrodes.

In the latter half of the initializing period, each of sustain electrode $SU_1$ to $SU_n$ is held at a positive voltage of Ve. Applied to each of scan electrodes $SC_1$ to $SC_n$ is a ramp waveform voltage gradually decreasing from a voltage of $V_{i3}$ not larger than discharge-starting voltage across the scan electrodes and sustain electrodes $SU_1$ to $SU_n$ to a voltage of $V_{i4}$ exceeding the discharge-starting voltage. During this application of the ramp voltage, second weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_{n-1}$. Then, the negative wall voltage on scan electrodes $SC_1$ to $SC_n$ and the positive wall voltage on sustain electrodes $SU_1$ to $SU_n$ are weakened. The positive wall voltage on data electrodes $D_1$ to $D_m$ is adjusted to a value appropriate for writing operation. The positive wall voltage on priming electrodes $PR_1$ to $PR_{n-1}$ is also adjusted to a value appropriate for priming operation. Thus, the initializing operation is completed.

In the writing period, scan electrodes $SC_1$ to $SC_n$ are once held at a voltage of Vc. Then, a voltage of Vq substantially equal to voltage change $V_c-V_{i4}$ is applied to priming electrodes $PR_1$ to $PR_{n-1}$.

Next, scan pulse Va is applied to scan electrode $SC_1$ of the first row. Then, priming discharge occurs between priming electrode $PR_1$ and projection 6*b*' in scan electrode $SC_1$. The priming diffuses inside of discharge cells $C_{1,1}$ to $C_{1,m}$ in the first row corresponding to scan electrode $SC_1$ of the first row and discharge cells $C_{2,1}$ to $C_{2,m}$ in the second row corresponding to scan electrode $SC_2$ of the second row. Because the priming cells are structured to easily discharge as described above, in this discharge, high-speed and stable priming discharge with a small discharge delay is obtained.

At the same time, positive write pulse voltage Vd is applied to data electrode $D_k$ (k being an integer ranging from 1 to m) corresponding to the signal of an image to be displayed in the first row, among data electrodes $D_1$ to $D_m$. Then, discharge occurs at the intersection of data electrode $D_k$ to which write pulse voltage Vd has been applied and scan electrode $SC_1$. This discharge develops to the discharge between sustain electrode $SU_1$ and scan electrode $SC_1$ in corresponding discharge cell $C_{1,k}$. Then, positive voltage accumulates on scan electrode $SC_1$ and negative voltage accumulates on sustain electrode $SU_1$ in discharge cell $C_{1,k}$. Thus, the writing operation in the first row is completed. As described above, because the priming discharge and writing discharge sequentially occur in the scanning period in the first row, the pulse width of the scan pulse applied to scan electrode $SC_1$ of the first row is the sum of time tp necessary for the priming discharge and time tw necessary for the writing operation, i.e. tp+tw.

Now, scan electrode $SC_1$ of the first row is a scan electrode in which writing is performed and the priming discharge is caused with scanning of the scan electrode. The discharge in discharge cell $C_{1,k}$ occurs with the priming supplied from the priming discharge that has occurred between scan electrode $SC_1$ and priming electrode $PR_1$. For this reason, although there is a delay in starting the supply of the priming from the priming cell, stable discharge with a small discharge delay can be obtained after the supply of the priming.

Next, scan pulse voltage Va having a pulse width smaller than the pulse width of the pulse applied to the scan electrode of the first row is applied to scan electrode $SC_2$ of the second row. At this time, positive write pulse voltage Vd is applied to data electrode $D_k$ corresponding to the signal of the image to be displayed in the second row, among data electrodes $D_1$ to $D_m$. Then, discharge occurs at the intersection of data electrode $D_k$ and scan electrode $SC_2$. This discharge develops to the discharge between sustain electrode $SU_2$ and scan electrode $SC_2$ in corresponding discharge cell $C_{2,k}$. Then, positive voltage accumulates on scan electrode $SC_2$ and negative voltage accumulates on sustain electrode $SU_2$ in discharge cell $C_{2,k}$. Thus, the writing operation in the second row is completed.

Now, the reason why the pulse width of the scan pulse applied to scan electrode $SC_2$ of the second row is smaller than the first pulse width, i.e. tp+tw, is as follows. Scan electrode $SC_2$ is a scan electrode in which writing is performed, but no priming discharge is caused during the scanning of the scan electrode $SC_2$. Thus, the discharge in discharge cell $C_{2,k}$ occurs with sufficient priming already supplied from the priming discharge that has occurred between scan electrode $SC_1$ and priming electrode $PR_1$. Therefore, time tp necessary for the priming discharge need not be taken into account. At this time, of course, the discharge delay in the writing discharge is extremely small and stable discharge can be obtained.

In a similar manner, a scan pulse having the first pulse width of tp+tw is applied to scan electrode $SC_3$ of the third row, and a write pulse is applied to data electrode $D_k$. Then, priming discharge occurs between priming electrode $PR_3$ and scan electrode $SC_3$ first, and priming is supplied to discharge cells $C_{3,1}$ to $C_{3,m}$ in the third row and discharge cells $C_{4,1}$ to $C_{4,m}$ in the fourth row. Successively, writing discharge occurs in discharge cell $C_{3,k}$ corresponding to data electrode $D_k$ to which the write pulse voltage has been applied.

Next, a scan pulse having a pulse width of tw is applied to scan electrode $SC_4$ of the fourth row, and a positive write pulse is applied to data electrode $D_k$. Then, in corresponding discharge cell $C_{4,k}$, stable writing discharge with an extremely a small discharge delay is caused by the influence of the priming already supplied.

The similar writing operations are performed in discharge cells including $C_{n,k}$ of the n-th row, and the writing operations are completed.

In this manner, in the writing operation in each of discharge cells $C_{p,1}$ to $C_{p,m}$ (p=odd number) in an odd-numbered row, a scan pulse having the first pulse width of tp+tw is applied to scan electrode $SC_p$, and a write pulse is applied to data electrode $D_k$. Then, priming discharge occurs between priming electrodes $PR_p$ and scan electrodes $SC_p$ first, and the priming is supplied inside of discharge cells $C_{p,1}$ to $C_{p,m}$ and discharge cells $C_{p+1,1}$ to $C_{p+1,m}$. Successively, writing discharge occurs in discharge cell $C_{p,k}$ corresponding to data electrode $D_k$ to which the write pulse voltage has been applied.

Next, in the writing operation in each of discharge cells $C_{p+1,1}$ to $C_{p+1,m}$ in even-numbered row, a scan pulse having a pulse width of tw is applied to scan electrode $SC_{p+1}$ of the (p+1)-th row, and a write pulse is applied to data electrode $D_k$. Then, in corresponding discharge cell $C_{p+1,k}$, stable writing discharge having an extremely a small discharge delay is caused by the influence of the priming already supplied.

In the sustaining period, after scan electrodes $SC_1$ to $SC_n$ and sustain electrodes $SU_1$ to $SU_n$ are reset to 0 (V) once, a positive sustain pulse voltage of Vs is applied to scan electrodes $SC_1$ to $SC_n$. At this time, in the voltage on scan electrode $SC_1$ and sustain electrode $SU_i$ in discharge cell $C_{i,j}$ in which writing discharge has occurred, the wall voltage accumulating on scan electrode $SC_i$ and sustain electrode $SU_i$ is added to sustain pulse voltage Vs. For this reason, the voltage exceeds the discharge-starting voltage and sustain discharge occurs. In a similar manner, by alternately applying sustain pulses to scan electrodes $SC_1$ to $SC_n$ and sustain electrodes $SU_1$ to $SU_n$, sustain discharge operations are successively performed in discharge cell $C_{i,k}$ in which the writing discharge has occurred, the number of times of sustain pulses.

As described above, unlike the writing discharge depending only on the priming in the initializing discharge in accordance with a conventional driving method, the writing discharge of the method of driving a panel in accordance with this embodiment of the present invention is performed with sufficient priming supplied from the priming discharge that has occurred during or immediately before the writing operation in respective discharge cells. This can achieve high-speed and stable writing discharge with a small discharge delay, and display a high-quality image.

Further, electrodes in the vicinity of the priming cells are priming electrodes 14 and scan electrodes 6 only. This also gives an advantage of stable action of the priming discharge itself because the priming discharge is unlikely to cause other unnecessary discharge, e.g. incorrect discharge involving the sustain electrodes.

Incidentally, respective electrodes of an AC type PDP are surrounded by the dielectric layers and insulated from the discharge space. For this reason, direct-current components make no contribution to discharge itself. Therefore, of course, even the use of a waveform in which direct-current components are added to the driving waveform of the exemplary embodiment of the present invention can provide similar effects.

Figure 5:
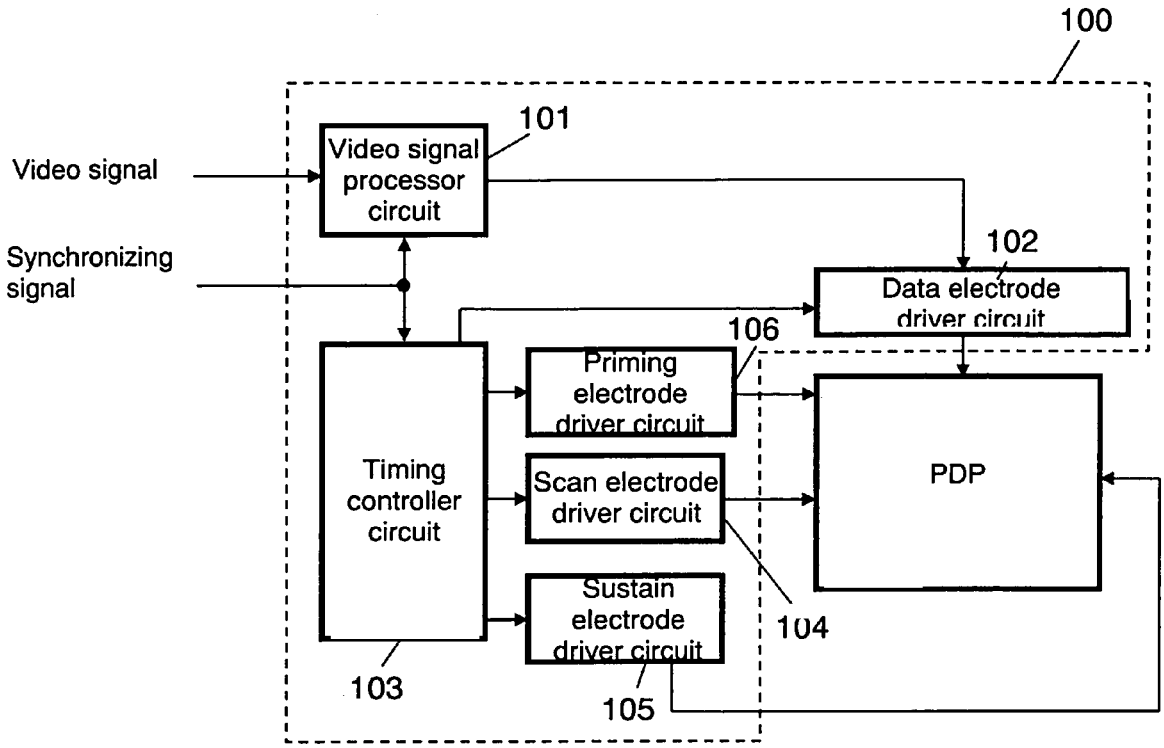
FIG. 5 is diagram showing an example of a circuit block of a driver for implementing the method of driving the panel.

FIG. 5 is a diagram showing an example of a circuit block of a driver for implementing the method of driving the panel used for the exemplary embodiment. Driver 100 of the exemplary embodiment of the present invention includes: video signal processor circuit 101, data electrode driver circuit 102, timing controller circuit 103, scan electrode driver circuit 104 and sustain electrode driver circuit 105, and priming electrode driver circuit 106. A video signal and synchronizing signal are fed into video signal processor circuit 101. Responsive to the video signal and synchronizing signal, video signal processor circuit 101 outputs a sub-field signal for controlling whether or not to light each sub-field, to data electrode driver circuit 102. The synchronizing signal is also fed into timing controller circuit 103. Responsive to the synchronizing signal, timing controller circuit 103 outputs a timing control signal to data electrode driver circuit 102, scan electrode driver circuit 104, sustain electrode driver circuit 105, and priming electrode driver circuit 106.

Responsive to the sub-field signal and the timing control signal, data electrode driver circuit 102 applies a predetermined driving waveform to the data electrodes (data electrodes $D_1$ to $D_m$ in FIG. 3) in the panel. Responsive to the timing control signal, scan electrode driver circuit 104 applies a predetermined driving waveform to the scan electrodes (scan electrodes $SC_1$ to $SC_n$ in FIG. 3) in the panel. Responsive to the timing control signal, sustain electrode driver circuit 105 applies a predetermined driving waveform to the sustain electrodes (sustain electrodes $SU_1$ to $SU_n$ in FIG. 3) in the panel. Responsive to the timing control signal, priming electrode driver circuit 106 applies a predetermined driving waveform to the priming electrodes (priming electrodes $PR_1$ to $PR_{n-1}$ in FIG. 3) in the panel. Necessary electric power is supplied to data electrode driver circuit 102, scan electrode driver circuit 104, sustain electrode driver circuit 105, and priming electrode driver circuit 106 from a power supply circuit (not shown).

The above circuit block can constitute a driver for implementing the method of driving the panel of the exemplary embodiment.

As described above, the present invention can provide a method of driving a plasma display panel capable of performing stable and high-speed writing operation.

INDUSTRIAL APPLICABILITY

As described above, the method of driving a plasma display panel of the present invention can perform stable and high-speed writing operation. Thus, the present invention is useful as a method of driving a plasma display panel.

The invention claimed is:

1. A plasma display system comprising:

a plasma display panel comprising:

a plurality of scan electrodes and a plurality of sustain electrodes arranged in parallel with each other, a plurality of data electrodes arranged in a direction intersecting said scan electrodes, and a plurality of priming electrodes parallel to said scan electrodes, for generating priming discharge between the priming electrodes and the corresponding scan electrodes;

wherein the plurality of scan electrodes includes priming-designated scan electrodes and non-priming-designated scan electrodes; and a driver operable to:

drive said plasma display panel according to field periods, wherein each field period includes a plurality of sub-fields, and each subfield includes an initializing period, writing period, and sustaining period, in the writing period:

apply a scan pulse of a first pulse width to said priming-designated scan electrodes, and perform writing and priming discharge on said priming-designated scan electrodes during the scan pulse of the first pulse width applied to said priming-designated scan electrodes; and apply a scan pulse of a second pulse width, which is smaller than the first pulse width, to said non-priming-designated scan electrodes, and perform writing but no priming discharge on said non-priming-designated scan electrodes during the scan pulse of the second pulse width applied to said non-priming-designated scan electrodes.

2. The plasma display system according to claim 1, wherein said plasma display panel further comprises:

a first substrate on which said sustain electrodes and said scan electrodes are formed;

a second substrate, opposite said first substrate, on which said data electrodes and said priming electrodes are formed;

a partition, on said second substrate, including first walls parallel to said data electrodes, and second walls perpendicular to said data electrodes;

discharge cells formed by said first walls and second walls;

a plurality of spaces formed by said second walls and formed between rows of said discharge cells; and projections formed on said priming-designated scan electrodes, respectively;

said projections and said priming electrodes face each other across said spaces, respectively; and said driver is operable to perform priming discharge between said projections and said priming electrodes.

3. The plasma display panel system according to claim 2, wherein said driver is operable to apply a voltage Vq to said priming electrodes, wherein the voltage Vq is substantially equal to Vc−Vi4, where Vc is a holding voltage applied to said scan electrodes and Vi4 is a voltage exceeding a discharge-starting voltage.

4. A method of driving a plasma display panel comprising a plurality of scan electrodes and a plurality of sustain electrodes arranged in parallel with each other, a plurality of data electrodes arranged in a direction intersecting the first and second scan electrodes, and a plurality of priming electrodes parallel to the scan electrodes, for generating priming discharge between the priming electrodes and the corresponding scan electrodes, wherein the plurality of scan electrodes includes priming-designated scan electrodes and non-priming-designated scan electrodes, said method comprising:

driving the plasma display panel according to field periods, wherein each field period includes a plurality of sub-fields, and each subfield includes an initializing period, writing period, and sustaining period;

in the writing period:

applying a scan pulse of a first pulse width to the priming-designated scan electrodes, and performing writing and priming discharge on the priming-designated scan electrodes during the scan pulse of the first pulse width applied to the priming-designated scan electrodes; and applying a scan pulse of a second pulse width, which is smaller than the first pulse width, to the non-priming-designated scan electrodes, and performing writing but no priming discharge on the non-priming-designated scan electrodes during the scan pulse of the second pulse width applied to the non-priming-designated scan electrodes.

5. The method according to claim 4, wherein the priming-designated scan electrodes, in which priming discharge is to be performed, each include a projection, and the priming discharge generated between the respective priming electrode and the priming-designated scan electrode to which the scan pulse is applied is generated between the respective priming electrode and the projection of the priming-designated scan electrode to which the scan pulse is applied.

* * * * *